US009341379B2

(12) United States Patent
Jin et al.

(10) Patent No.: US 9,341,379 B2
(45) Date of Patent: May 17, 2016

(54) PORTABLE GAS HEATER

(76) Inventors: Weiqun Jin, Shenzhen (CN); Weidong Jin, Shenzhen (CN)

( * ) Notice: Subject to any disclaimer, the term of this patent is extended or adjusted under 35 U.S.C. 154(b) by 215 days.

(21) Appl. No.: 13/557,195

(22) Filed: Jul. 24, 2012

(65) Prior Publication Data

US 2013/0104879 A1 May 2, 2013

Related U.S. Application Data

(63) Continuation-in-part of application No. 13/317,809, filed on Oct. 28, 2011, now abandoned.

(51) Int. Cl.

| | |
|---|---|
| ***F24C 1/02*** | (2006.01) |
| ***F23Q 2/00*** | (2006.01) |
| ***F24C 3/04*** | (2006.01) |
| ***F24C 3/14*** | (2006.01) |
| ***F24C 15/00*** | (2006.01) |

(52) U.S. Cl.

CPC ... *F24C 3/04* (2013.01); *F24C 3/14* (2013.01); *F24C 15/00* (2013.01)

(58) Field of Classification Search

CPC ..... F24C 3/06; F24C 3/14; F24C 3/04; F24C 3/08; F24C 3/20; F24D 15/02; F17C 2205/0153; F17C 2205/0157; F17C 2205/0192; F17C 2205/0107

USPC ..... 126/91 R, 92 AC, 92 B, 92 C; 431/326–329, 344; 248/103, 310, 248/447.2

See application file for complete search history.

(56) References Cited

U.S. PATENT DOCUMENTS

| | | | | |
|---|---|---|---|---|
| 3,202,205 | A * | 8/1965 | Webster | 48/180.1 |
| 5,795,145 | A * | 8/1998 | Manning | F24C 3/122 431/280 |
| 7,434,447 | B2 * | 10/2008 | Deng | 73/23.2 |
| 8,636,503 | B2 * | 1/2014 | Kasprzyk et al. | 431/278 |
| 2003/0034026 | A1 * | 2/2003 | McCalley et al. | 126/92 R |
| 2003/0070658 | A1 * | 4/2003 | Warner et al. | 123/456 |
| 2008/0153044 | A1 * | 6/2008 | Deng | F23N 1/005 431/74 |
| 2009/0250582 | A1 * | 10/2009 | Ziaylek | 248/312 |

* cited by examiner

*Primary Examiner* — Avinash Savani
*Assistant Examiner* — Vivek Shirsat
(74) *Attorney, Agent, or Firm* — Raymond Y. Chan; David and Raymond Patent Firm

(57) ABSTRACT

A portable gas heater includes a heater body, a gas burner mounted on a front panel of the heater body, a gas supply arrangement connected between the gas burner inside the heater body and the gas bottle for providing a gas passage including a safety valve, a control button and a connecting tube, a gas bottle positioning arrangement, and a pilot flame arrangement mounted on the heater body near the gas burner and connected to the safety valve through a gas inlet. The pilot flame arrangement includes a thermocouple, a pilot flame unit, and an electrode rod connected to an ignition wire of the safety valve. The pilot flame unit includes a pilot fire nozzle, a mixing tube and a connector connected with each others. The heater is compact, small and light-weighted while ready for immediate use without assembly and disassembly requirements, thereby convenience for indoor and outdoor use.

8 Claims, 5 Drawing Sheets

PORTABLE GAS HEATER

CROSS REFERENCE OF RELATED APPLICATION

This is a Continuation-In-Part that claims the benefit of priority under 35 U.S.C. §119 to a non-provisional application, application Ser. No. 13/317,809, filed Oct. 28, 2011.

BACKGROUND OF THE PRESENT INVENTION

1. Field of Invention

The present invention relates to a gas heater, and more particularly to a portable gas heater which has an integrally formed body arranged for use without assembly.

2. Description of Related Arts

Outdoor gas heater in the market has a variety of model and design. For example, Chinese patent application CN201028636Y discloses an outdoor portable gas heater canopy which includes a plurality of different parts such as gas strap and gas positioning unit while having a small size and is light weighted, and the different parts of the gas heater can be assembled or disassembled easily in a tool-less manner so as to provide convenience to the user for carrying for travel or outdoor activities. However, the need of assembling the different parts into one usable unit still imposes great inconvenience to the user. The user still has to wait and assemble the unit before use. In other words, the gas heater is still not immediately available for use when needed.

SUMMARY OF THE PRESENT INVENTION

The invention is advantageous in that it provides a portable gas heater which is a self-contained integral unit available for immediate indoor or outdoor use without assembly.

Additional advantages and features of the invention will become apparent from the description which follows, and may be realized by means of the instrumentalities and combinations particular point out in the appended claims.

According to the present invention, the foregoing and other objects and advantages are attained by a portable gas heater which comprises a heater body, a gas burner, a gas supply arrangement arranged for connecting to a gas bottle which contains a gas supply, and a gas bottle positioning arrangement, wherein the heater body comprises a front panel, a door, two side panels, a top panel and a bottom panel connecting together to form the heater body, wherein the gas burner is screw mounted on the front panel of the heater body, wherein the gas supply arrangement is connected to the gas burner for providing a gas passage between the gas burner and the gas bottle, wherein the gas supply arrangement comprises a safety valve, a control button provided on the safety valve and a connecting tube, wherein the gas bottle is arranged for receiving inside the heater body to secure into position for providing gas supply.

The characteristic of this type of portable gas heater is that: the gas burner is an infrared burner which has two inner cavities.

In particular, the gas heater comprises a pilot flame arrangement provided for the gas passage, wherein the safety device comprises a thermocouple, a pilot flame unit, and an electrode rod. The pilot flame arrangement is coupled to the heater body by screw at a position which is proximal to the gas burner, wherein the pilot flame arrangement comprises a gas inlet connected to the safety valve. The gas inlet of the pilot flame arrangement further connects to a gas outlet of the pilot flame unit. The electrode rod of the pilot flame arrangement is connected to an ignition wire of the safety valve, wherein the pilot flame unit comprises a pilot fire nozzle, a mixing tube and a connector cooperatively connecting with each others.

In accordance with another aspect of the invention, the present invention is also characterizing in that: the gas heater is an infrared heater comprises a protective shield thereof, and is a ceramic burner or an iron chromium aluminum sinter net burner.

The gas bottle positioning arrangement comprises a bottle positioning ring horizontally positioned and arranged to fit with a central curved portion of an upper part of the cylindrical body of the gas bottle, a bottle positioning bar having an Ω construction which is arranged to bias against a central horizontal portion of the upper part of the cylindrical body of the gas bottle and a bottle positioning base mounted onto the bottom panel of the heater body which comprises two positioning tubes and a resilient element on each of the positioning tubes, wherein the positioning ring is provided on an inner side of the side panels of the heater body, wherein the positioning bar two ends inserting and connecting securely to the two positioning tubes of the positioning base respectively in such a manner that the bottle positioning bar and the bottle positioning ring forms a clipping and positioning unit through a spring action of the resilient element to secure the gas bottle into position.

The heater body has an inner cavity arranged for receiving the gas bottle which is a 3~5 pounds such that the gas bottle is secured onto the bottom panel inside the inner cavity of the heater body, wherein the connecting tube of the gas supply arrangement is capable of connecting to a gas bottle which is more than 3 pounds positioned proximal to the heater body through the connecting tube of the gas supply arrangement.

Preferably, the gas bottle which is positioned outside the inner cavity of the heater body is between 3~20 pounds.

The safety valve and the control button are mounted on the top panel of the heater body, wherein the control button is mounted directly onto a shaft of the safety valve.

The present invention is further characterizing in that: the gas supply arrangement further comprises a nozzle facing the gas burner, a nozzle head connector and a regulator, wherein the nozzle is connected to the nozzle head connector, wherein the nozzle head connector is connected to a gas outlet of the safety valve through the connecting tube, wherein the safety valve is connected to the regulator.

The connecting tube is a stainless steel bellow, a semi-soft brass tube or a semi-soft aluminum tube.

The heater body is an enclosure structure which includes curved surface in its top and bottom, left and right side.

In particular, the heater body has an enclosure structure which is formed through the front panel, the door which also serves as a rear panel, the two side panels, the top panel and the bottom panel mounting together in such a manner that the door is capable of moving between an open position at which the inner cavity of the heater body is exposed and a close position at which the enclosure structure is formed, wherein the door has a first side pivotally connecting to one the side panel through a door axis and comprises a door locking unit provided on a second opposite side cooperatively connecting to another the side panel.

Alternately, the heater body is formed by a front panel, a rear panel, two side panels, a top panel and a bottom panel screw mounting together to form an enclosure structure, wherein the door is provided through one of the side panel and is capable of moving between an open position at which the inner cavity of the heater body is exposed and a close position at which the enclosure structure is formed.

The heater body further provides an anti-collapse switch which is connected to the thermocouple of the pilot flame arrangement and to the gas inlet of the safety valve through a connecting wire.

The portable gas heater further comprises a transportation construction which is selected from the group consisting of: a handle provided on the top panel, a unit handle which is a should type hanging ring, a rolling wheel provided on the bottom panel, and a unit positioning unit on the heater body for securing the heat body onto a vehicle to facilitate transportation.

Compared to a conventional gas heater, the advantageous effect of the present invention is that the portable gas heater is compact in size, small in volume and light in weight which does not require any assembly or disassembly step and is immediately available for use, thereby perfectly matching the need of zero waiting time and immediate use requirements of a user, and is suitable to carry for outdoor or to move during indoor use.

Still further objects and advantages will become apparent from a consideration of the ensuing description and drawings.

These and other objectives, features, and advantages of the present invention will become apparent from the following detailed description, the accompanying drawings, and the appended claims.

BRIEF DESCRIPTION OF THE DRAWINGS

In FIGS. 1 to 9 of the drawings, a list of numerical reference for the elements of the gas heater is provided as follows: 1-heater body; 2-infrared burner; 3-gas bottle; 4-door; 5-handle; 6-control button; 7-connecting tube; 8-nozzle; 9-gas regulator; 10-pilot flame arrangement; 11-electrode rod; 12-ignition wire; 13-bottle positioning ring; 14-bottle positioning bar; 15-bottle positioning base; 16-safety switch; 17-thermocouple; 18-front panel; 19-left side panel; 20-top panel; 21-bottom panel; 22-nozzle head connector; 23-safety valve; 24-door locking unit; 25-door axis; 26-unit handle; 27-right side panel; 28-safety cover; 29-connector; 30-mixing tube; 31-pilot fire nozzle; 32-thermocouple wire element; 33-electrode wire element.

DETAILED DESCRIPTION OF THE PREFERRED EMBODIMENT

The present invention is further described through the following exemplary embodiments and the accompanying drawings.

Embodiment 1

Figure 1:
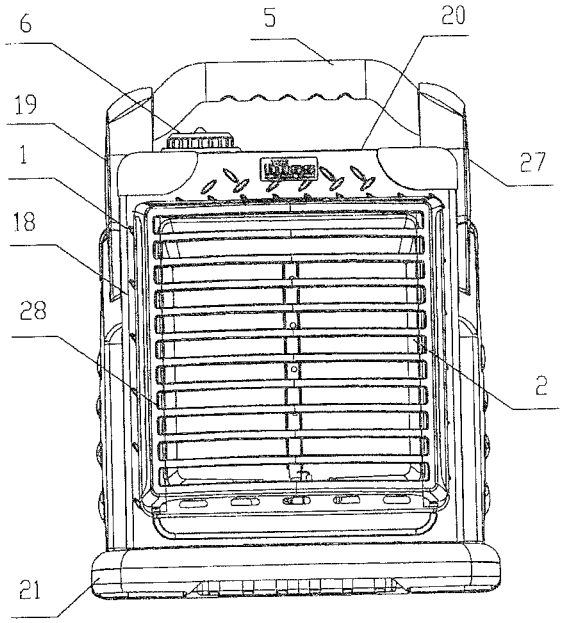
FIG. 1 is a front illustration of a gas heater according to a preferred embodiment of the present invention.
Figure 2:
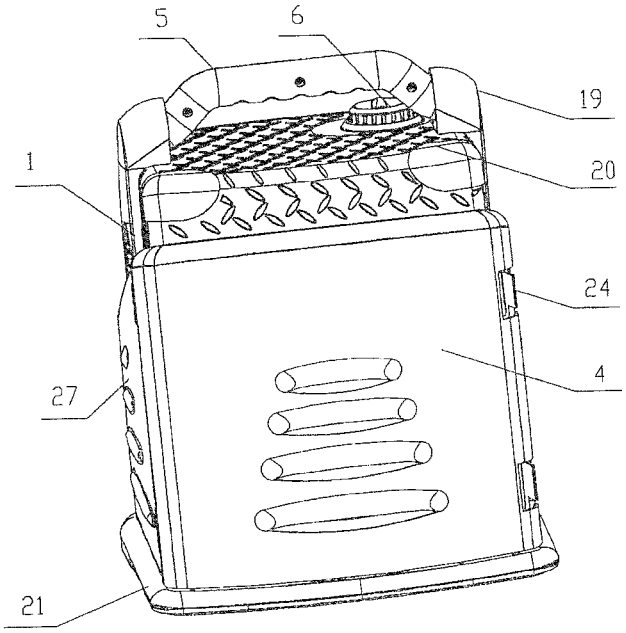
FIG. 2 is a rear illustration of a gas heater according to the above preferred embodiment of the present invention.
Figure 3:
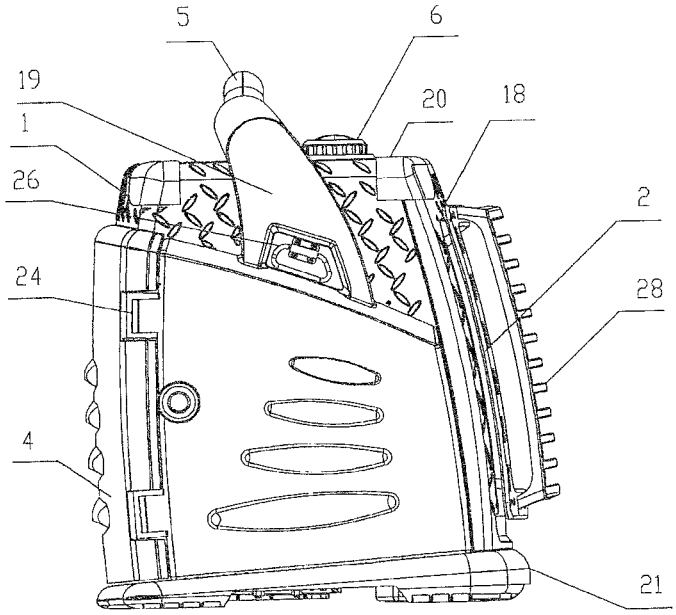
FIG. 3 is a side illustration of a gas heater according to the above preferred embodiment of the present invention.
Figure 4:
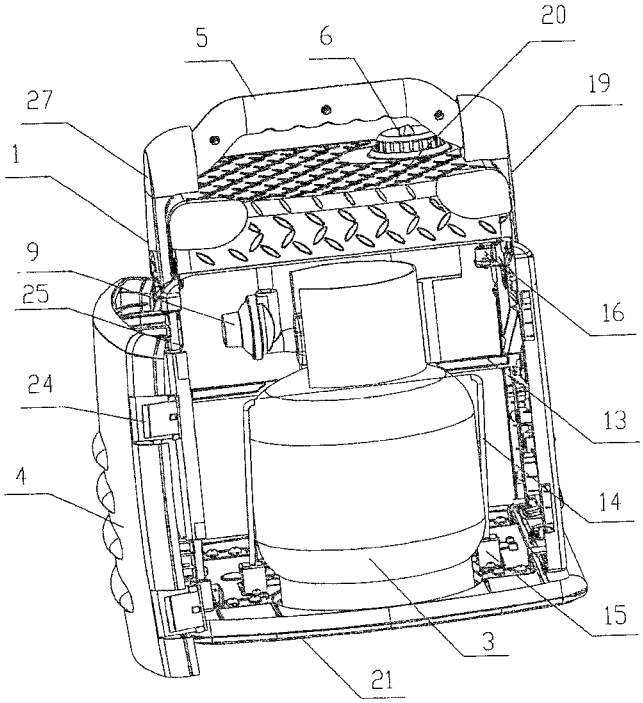
FIG. 4 is an illustration of a gas heater at which a door is in an open position according to the above preferred embodiment of the present invention.
Figure 5:
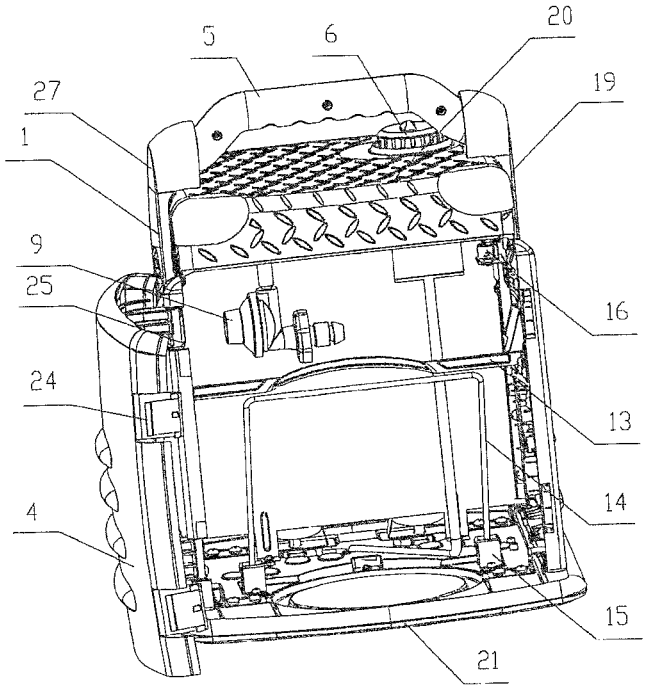
FIG. 5 is an illustration of a gas heater without a gas bottle according to the above preferred embodiment of the present invention.
Figure 6:
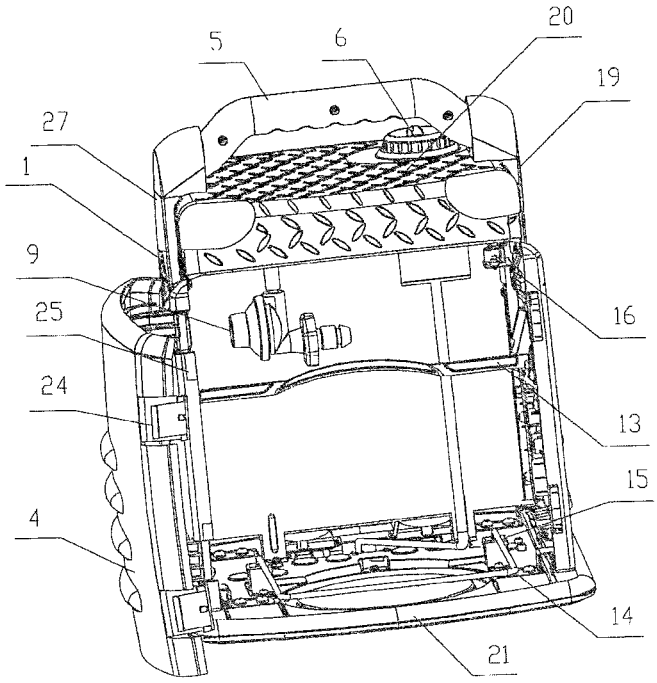
FIG. 6 is an illustration of a gas heater of which a bottle position unit is in a released position according to the above preferred embodiment of the present invention.
Figure 7:
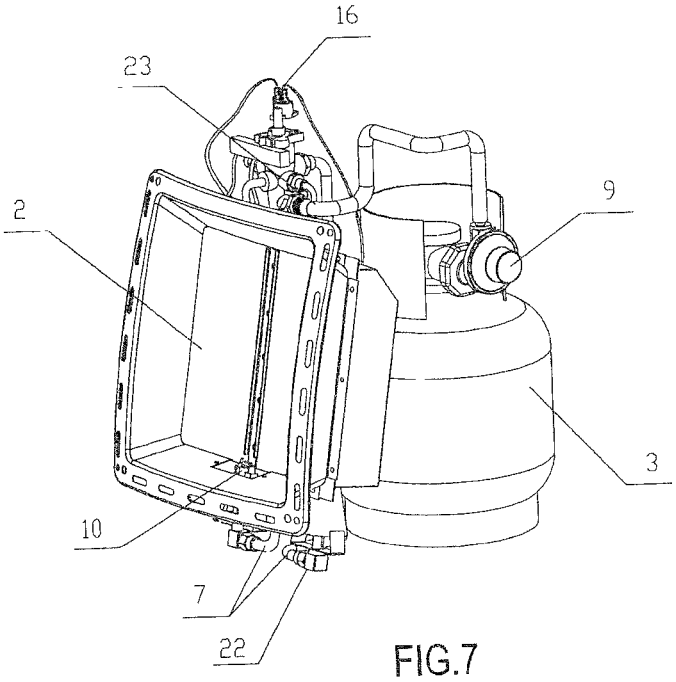
FIG. 7 is an illustration of an upper portion of a burner connecting with a gas bottle according to the above preferred embodiment of the present invention.
Figure 8:
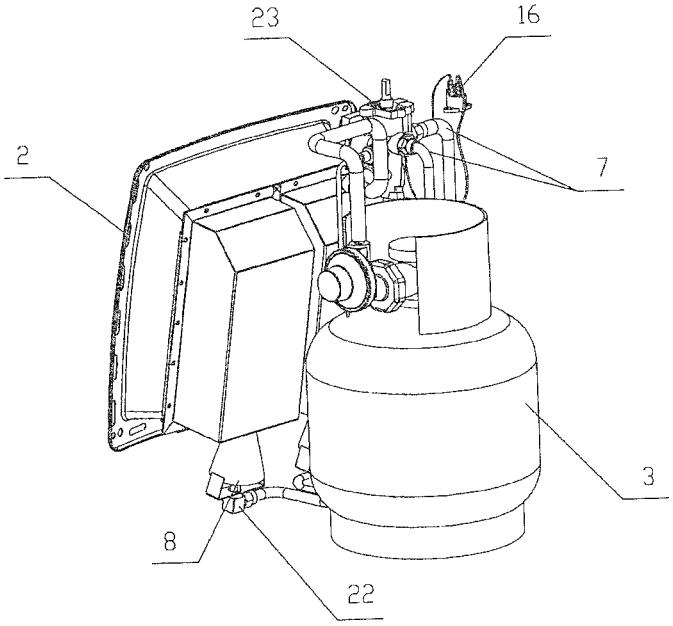
FIG. 8 is an illustration of a lower portion of a burner connecting with a gas bottle according to the above preferred embodiment of the present invention.
Figure 9:
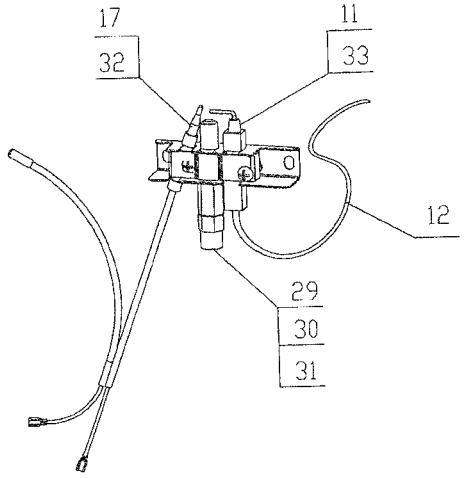
FIG. 9 is an illustration of the pilot flame arrangement of a gas heater according to the above preferred embodiment of the present invention.

Referring to FIGS. 1 to 10 of the drawings, a portable gas heater according to a preferred embodiment of the present invention is illustrated. The portable gas heater is compact in size and light in weight which is suitable for indoor and outdoor use and has an integral one unit construction such that the gas heater is available for use by the user without any tool or assembly requirements.

The portable gas heater includes a heater body 1, an infrared burner 2, a gas supply arrangement, a gas bottle 3 and a plurality of positioning parts for the gas bottle 3.

In particular, the heater body 1 includes a front panel 18, a door 4, a left side panel 19, a right side panel 27, a top panel 20 and a bottom panel 21 which are mounted securely to form the heater body 1 in such a manner that the heater body 1 is an integral body having an inner cavity opened through the door 4 at an open position. The door 4 is mounted with the left side panel 19 through a door axis 25 and is cooperatively connected to the right side panel 27 through a door locking unit 24 such that a close position is defined when the door 4 is locked into position with the right side panel 27 through the door locking unit 24 and the open position is defined when the door 4 is unlocked with the right panel 27 at which the door locking unit 24 is in a released position. The heater body 1 further comprises a handle 5 on the top panel which provides a gripping point for carrying and moving the heater body 1.

The infrared burner 2 is a ceramic burner of 11 inches water column which has at least one inner cavity and a protective shield. Preferably, the infrared burner 2 has two inner cavities. Preferably, the infrared burner 2 is mounted to the front panel 18 of the heater body 1 with mounting screws.

The gas supply arrangement is to provide a gas passage connecting between the infrared burner 2 and the gas bottle 3. The gas bottle 3, such as the standard steel gas cylinder, contains gas supply which is then guided to flow to the infrared burner 2 through the gas supply arrangement.

In particular, the gas supply arrangement comprises a safety valve 23, a control button 6 provided on the safety valve 23, a connecting tube 7 such as a stainless steel bellow connecting to the safety valve 23, a nozzle 8 having a first end facing directly at the inner cavity of the infrared burner 2, a nozzle head connector 22 connecting to a second end of the nozzle 8 which is opposite to the first end of the nozzle 8 and a gas regulator 9 connected to a valve of the gas bottle 3 and to the connecting tube 7. Preferably, the safety valve 23 and the control button 6 are mounted onto the top panel 20 of the heater body 1 with mounting screws. The nozzle 8 is connected to the nozzle head connector 22 through a threaded arrangement. The nozzle head connector 22 is connected to the connecting tube 7. The connecting tube 7 is connected to a gas outlet of the safety valve 23 and the gas regulator 9 is connected to a gas inlet of the safety valve 23.

The gas bottle 3 is a 5 lbs gas cylinder which is provided inside the heater body 1 and is securely positioned onto the bottom panel 21 inside the inner cavity of the heater body 1.

In the gas passage, a pilot flame arrangement 10 is included. The pilot flame arrangement comprises a thermocouple 17, a pilot flame unit, an electrode rod 11, a thermocouple wire element 32, and an electrode wire element 33.

The pilot flame arrangement 10 is mounted, preferably by screw, onto a positional panel onto which the infrared burner is soldered. The gas inlet of the pilot flame unit of the pilot flame arrangement 10 is operatively connected to the safety valve 23. The electrode rod 11 of the pilot flame arrangement 10 is operatively connected to the ignition wire 12 of the safety valve 23. The pilot flame unit comprises a pilot fire nozzle 31, a mixing tube 30 and a connector 29. When the control button 6 of the safety valve 23 is actuated, such as by turning, to a first preset position, an initial ignition process is started. The gas is arranged to flow to the pilot flame arrangement 10 through the gas inlet of the pilot flame arrangement, the electrode rod 11 of the pilot flame arrangement 10 is then electrified to ignite a pilot light. When the pilot flame arrangement 10 is stable, the control button 6 of the safety valve 23 is actuated, by turning the control button 6, to a second preset position, the gas is arranged to inject into the inner cavity of the infrared burner 2 toward a right side of the inner cavity of the infrared burner 2 through the connecting tube 7, the nozzle head connector 22 and the nozzle 8. When the control button 6 of the safety valve 23 is turned again to a third preset position, the gas is arranged to inject into the inner cavity of the infrared burner 2 toward a left side of the inner cavity of the infrared burner 2 through the connecting tube 7 and the nozzle 8.

The gas bottle 3 is secured into position through a gas bottle positioning arrangement which comprises a bottle positioning ring 13, a bottle positioning bar 14 and a bottle positioning base 15. The bottle positioning ring 13 is horizontally positioned and is arranged to fit with a central curved portion of an upper part of the cylindrical body of the gas bottle 3. The bottle positioning bar 14 generally has a Ω construction which is arranged to bias against a central horizontal portion of the upper part of the cylindrical body of the gas bottle 3. The bottle positioning base 15 is mounted onto the bottom panel 21 and comprises two positioning tubes and a resilient element on each of the positioning tubes. The horizontally positioned bottle positioning ring 13 is provided at an inner side of the side panel of the heater body 1. The bottle positioning bar 14 has two ends inserting and connecting securely to the two positioning tubes of the bottle positioning base 15 respectively in such a manner that the bottle positioning bar 14 and the bottle positioning ring 13 forms a clipping and positioning unit through the spring action of the resilient element defining a clipping position. When the bottle positioning bar 14 is forced to move to a horizontal position toward a direction which is outwardly and horizontally extended outside the door 4 of the heater body 1 against the spring action of the resilient element, the gas bottle 3 can be placed into the heater body 1 at a preset position on the bottom panel 21, then under the spring action, the bottle positioning bar 14 is returned to the clipping position such that the bottle positioning bar 14 and the bottle positioning ring 13 are capable of working together to embrace the gas bottle 3 into position in a secure manner, thereby ensuring a safety operation of the heater.

The heater body 1 comprises a safety switch 16 on the left side panel 19. The safety switch 16 has an anti-collapse switch which is screw mounted to the left side panel 19 and is connected to the thermocouple 17 of the pilot flame arrangement 10 and to the gas inlet of the safety valve 23 through connecting wire.

Embodiment 2

The construction is basically identical to the embodiment 1 except that the infrared burner 2 has two inner cavities and an iron chromium aluminum sinter net and the heater body 1 has a unit handle 26 on one of the two side panels arranged for providing a shoulder type hanging ring for carriage.

Embodiment 3

The construction is basically identical to the embodiment 1 except that the gas connecting tube being used is semi-soft brass tube, the heater body 1 comprises the front panel 18, a side door, the right side panel 27, a rear panel, the top panel 20 and the bottom panel 21 which are screw mounted into an integral body in which the side door is connected to the front panel 18 through the door axis 25 and is operatively connected with the right side panel 27 through the door locking unit 24. The heater body 1 further comprises a rolling wheel unit on the bottom panel 21 for facilitating sliding movement.

Embodiment 4

The construction is basically identical to the embodiment 1 except that the gas connecting tube being used is semi-soft aluminum tube and the heater body 1 comprises a unit positioning unit arranged for selectively securing the heater body 1 on a vehicle to facilitate transportation such that the heater body 1 can be placed onto a vehicle and securely positioned on the vehicle through the unit positioning unit.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A portable gas heater, comprising:

a heater body which comprises, a top panel, a front panel, a bottom panel, and two side panels;

a gas burner mounted on said front panel of said heater body, wherein said gas burner has two inner cavities;

a gas bottle positioning arrangement which is provided at said heater body for securely receiving a gas bottle inside said heater body to serves as a gas supply and is connected to said gas burner for providing a gas passage between said gas burner and said gas bottle, wherein said gas bottle positioning arrangement comprises a bottle positioning ring horizontally positioned and provided on inner sides of said side panels of said heater body for fitting a central curved portion of an upper part of a cylindrical body of said gas bottle, a bottle positioning bar having a Ω construction for biasing against a central horizontal portion of said upper part of said cylindrical body of said gas bottle, and a bottle positioning base mounted onto said bottom panel of said heater body, wherein said bottom positioning base comprises two positioning tubes and a resilient element on each of said positioning tubes, wherein said positioning bar two ends connected securely to said two positioning tubes of said bottle positioning base respectively, wherein said bottle positioning bar and said bottle positioning ring form a clipping and positioning unit through a spring action of said resilient element to secure said gas bottle into position when said gas bottle is disposed on said bottom panel of said heater body;

a gas supply arrangement, which is arranged for connecting to said gas bottle, comprising a safety valve, a control button provided on said safety valve and two connecting tubes linked to said inner cavities of said gas burner respectively, wherein said control button is actuated among first, second, and third preset positions; and a pilot flame arrangement mounted on said heater body at a position which is proximal to said gas burner, wherein said pilot flame arrangement comprises a thermocouple, a pilot flame unit, and an electrode rod operatively connecting with each other, wherein said pilot flame unit comprises a gas inlet connected to said safety valve, wherein said electrode rod is connected to an ignition wire of said safety valve, wherein said pilot flame unit comprises a pilot fire nozzle, a mixing tube and a connector cooperatively connecting with each others, wherein in said first preset position of said control button, said electrode rod is electrified for igniting gas ejected at said pilot flame unit to generate a pilot light, wherein in said second preset position of said control button, said gas is injected into one of said inner cavities of said infrared burner through one of said connecting tubes, wherein in said third preset position of said control button, said gas is injected into said inner cavities of said infrared burner through said connecting tubes.

2. The portable gas heater, as recited in claim 1, wherein said heater body further comprises a door serving as a rear panel to form an enclosure structure by said front panel, said door, said two side panels, said top panel, and said bottom panel, wherein said door is pivotally moved between a close position for enclosing said gas bottle within said enclosure structure, and an open position that said bottle positioning bar is moved to extend out of said door against said spring action of said resilient element, so as to enable said gas bottle to be disposed inside said enclosure structure.

3. The portable gas heater, as recited in claim 2, wherein said safety valve and said control button are mounted on said top panel of said heater body, wherein said control button is mounted directly onto a shaft of said safety valve.

4. The portable gas heater, as recited in claim 3, wherein said gas supply arrangement further comprises a nozzle having a first end facing directly at each of said inner cavities, a nozzle head connector connected to a second end of said nozzle, and a regulator connected to said safety valve and to a valve of said gas bottle, wherein said nozzle head connector is connected to a gas outlet of said safety valve through each of said connecting tubes.

5. The portable gas heater, as recited in claim 4, wherein said gas heater is a heater selected from a group consisting of an infrared heater comprising a protective shield thereof, a ceramic burner, and an iron chromium aluminum sinter net burner.

6. The portable gas heater, as recited in claim 5, wherein said connecting tube is selected from the group consisting of a stainless steel bellow, a semi-soft brass tube and a semi-soft aluminum tube.

7. The portable gas heater, as recited in claim 6, further comprising an anti-collapse switch provided on said heater body which is connected to said thermocouple of said pilot flame arrangement and to a gas inlet of said safety valve through a connecting wire.

8. The portable gas heater, as recited in claim 7, further comprising a transportation construction which is selected from the group consisting of a handle provided on said top panel, a unit handle which is a shoulder type hanging ring, a rolling wheel provided on said bottom panel, and a unit positioning unit on said heater body for securing said heat body onto a vehicle to facilitate transportation.

* * * * *